US006695927B1

(12) United States Patent
Hollwedel et al.

(10) Patent No.: US 6,695,927 B1
(45) Date of Patent: Feb. 24, 2004

(54) METHOD AND CLEANING SOLUTION FOR CLEANING A CONTAINER

(75) Inventors: Ursula Hollwedel, Schnaittach (DE); Klaus Kuhnke, Erlangen (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/718,897

(22) Filed: Nov. 22, 2000

Related U.S. Application Data

(63) Continuation of application No. PCT/DE99/01500, filed on May 19, 1999.

(30) Foreign Application Priority Data

May 22, 1998 (DE) ..... 198 22 994
May 6, 1999 (DE) ..... 199 20 982

(51) Int. Cl.[7] ..... B08B 9/00

(52) U.S. Cl. ..... 134/2; 134/22.1; 134/22.11; 134/22.14; 134/22.17; 134/22.19; 134/36; 134/40; 134/42; 510/245; 510/247; 510/254

(58) Field of Search ..... 510/245, 247, 510/254; 134/2, 22.1, 22.11, 22.14, 22.17, 22.19, 36, 40, 42

(56) References Cited

U.S. PATENT DOCUMENTS 3,308,065 A * 3/1967 Lesinski et al. ..... 134/42
3,754,990 A * 8/1973 Teumac et al. ..... 134/2
3,854,996 A * 12/1974 Frost et al. ..... 134/2
3,951,827 A * 4/1976 Burroughs et al. .... 252/8.55 B
4,279,768 A * 7/1981 Busch ..... 252/180
4,442,009 A * 4/1984 O'Leary et al. ..... 210/697
4,454,046 A * 6/1984 Wallace et al. ..... 210/698
4,586,961 A * 5/1986 Bradley et al. ..... 134/2
4,666,528 A * 5/1987 Arrington et al. ..... 134/2
4,950,474 A * 8/1990 Hinrichsen et al. ..... 422/15
5,164,015 A * 11/1992 Kuhnke et al. ..... 134/2
5,180,498 A * 1/1993 Chen et al. ..... 210/697

FOREIGN PATENT DOCUMENTS

| | | | |
|---|---|---|---|
| AT | 281 541 | | 5/1970 |
| DE | 1023958 | | 3/1966 |
| DE | 25 05 252 | A1 | 8/1975 |
| DE | 129 367 | | 1/1978 |
| EP | 0 273 182 | A1 | 7/1988 |
| GB | 1023958 | * | 7/1962 |

OTHER PUBLICATIONS

International Search Report, PCT/DE99/01500, May 1999.*
Christian Rossmann: "Metallentfettung in sauren Lösungen" [degreasing metals in acidic solutions], *Galvanotechnik, vol. 62, 1971, No. 7, pp. 548–565.*

* cited by examiner

*Primary Examiner*—Sharidan Carrillo
(74) *Attorney, Agent, or Firm*—Laurence A. Greenberg; Werner H. Stemer; Gregory L. Mayback

(57) ABSTRACT

A method and a solution are provided for cleaning a container, in particular a boiler of a conventional power station. The container is degreased and pickled in one method step using an alkaline cleaning solution. A suitable cleaning solution includes, for example, an ammonium EDTA salt, hydrazine and a surfactant.

8 Claims, No Drawings

METHOD AND CLEANING SOLUTION FOR CLEANING A CONTAINER

CROSS-REFERENCE TO RELATED APPLICATION

This application is a continuation of copending International Application No. PCT/DE99/01500, filed May 19, 1999, which designated the United States.

BACKGROUND OF THE INVENTION

Field of the Invention

The invention relates to a method and a solution for cleaning a container, in particular a boiler of a conventional power station.

Containers, in particular power station boilers, must be cleaned, especially before operating the power station. Such boilers frequently contain greasy residues and deposits of magnetite and lime which are to be removed.

A paper by Christian Rogmann entitled "Metallentfettung in sauren Lösungen" [Degreasing Metals in Acidic Solutions] in Galvanotechnik 62 (1971) No. 7 discloses adding surfactants, which cause degreasing, to an acid which is used for removing rust from a metal surface. The solution used, which permits the combining of degreasing and pickling, is always acidic. An acidic solution of this type can cause parent metal corrosion.

A method for pickling metallic inner surfaces of closed vessels is disclosed by Austrian patent 281 541. This method is composed of three method steps. In a first step, termed pretreatment, wetting agents are introduced into the container. These wetting agents work to degrease the surface before the main treatment begins, so that the surface can then be wetted directly by a cleaning solution during the main treatment. The main treatment envisages the introduction of a mixture of complex-forming acids, hydrazine and cyclic amines, such that a pH between 3 and 5 is established by the amines and, if appropriate, by ammonia. The main treatment therefore takes place with an acidic solution.

A pH between 8.5 and 10 is not established until a subsequent posttreatment using volatile alkalizing agents. During that posttreatment, a thin magnetite protective layer forms on the container surface.

Heretofore it was also frequently customary to rinse the container with water between the individual cleaning steps. This is necessary in particular if the main treatment is a pickling with hydrofluoric acid.

SUMMARY OF THE INVENTION

It is accordingly an object of the invention to provide a method and a cleaning solution for cleaning a container that overcomes the above-mentioned disadvantages of the prior art methods and products of this general type, in which grease, magnetite and lime can be removed from the container in a simple and inexpensive manner, in particular, without the use of hydrofluoric acid, which is a hazardous substance (classification T, C).

A preferred ammonium EDTA salt is triammonium EDTA. Of many suitable surfactants a preferred example is the ethoxylated fatty alcohol surfactant sold by BASF under the tradename Plurafac. These compounds give an optimum cleaning result. This applies in particular when using the stated percentage compositions of the cleaning solution.

The advantage achieved according to the invention is that the method can be carried out considerably more rapidly than heretofore with the same cleaning result. This is possible, in particular, due to the fact that rinsing steps can be omitted. Since the cleaning solution is always alkaline, interfering parent metal corrosion cannot occur. Since only one method step is provided, not only is it unnecessary to drain the container between two steps, but also the specific feeding of chemicals for the individual method steps is unnecessary. Using only one method step, greasy residues and deposits of magnetite and lime can be removed without parent metal corrosion occurring.

The pH of the cleaning solution is suitably 8.5 or higher. Preferably, the pH of the cleaning solution is also 10 or less. An expedient pH is thus between 8.5 and 10. This ensures good cleaning without the risk of parent metal corrosion existing.

The method is carried out, for example, at a low temperature, preferably below 100° C. A method of this type is energetically expedient and is feasible because, surprisingly, it has been found that such a low temperature is sufficient for a good cleaning result.

Also in accordance with the invention, magnetite deposits and lime deposits are removed simultaneously by the pickling, provided that magnetite and lime are present simultaneously in the container. Advantageously, a separate method step is not needed to remove lime deposits.

In a preferred embodiment of the invention, a solution of ammonium EDTA salt, hydrazine and surfactant is introduced into the vessel as cleaning solution. This solution advantageously makes it possible to degrease and pickle the container in only one method step. Hydrofluoric acid is not required.

The cleaning solution for cleaning in one method step preferably comprises from 40% to 50% ammonium EDTA salt, from 0.1% to 2% hydrazine, from 0.1% to 0.5% surfactant and, for the rest, water. A particularly preferred composition of the cleaning solution envisages: 45% ammonium EDTA salt, 1% hydrazine, 0.1% surfactant and 53.9% water. All percentages are percent by weight.

A preferred ammonium EDTA salt is triammonium EDTA. Of many suitable surfactants a preferred example is the surfactant sold by BASF under the tradename PLURAFAC. These compounds give an optimum cleaning result. This applies in particular when using the stated percentage compositions of the cleaning solution.

The method for cleaning a container according to the invention achieves in particular the advantage that grease, lime and magnetite can be removed in only one method step, not only without using hazardous hydrofluoric acid but even using a non-acidic cleaning solution. Hazardous hydrofluoric acid is not necessary, nor must complex rinsing steps be carried out. Finally, the method can be carried out in energetically expedient manner at low temperature, for example below 100° C. Other features which are considered as characteristic for the invention are set forth in the appended claims.

Although the invention is described herein as embodied in a method and a solution for cleaning a container, it is nevertheless not intended to be limited to the details given, since various modifications and structural changes may be made therein without departing from the spirit of the invention and within the scope and range of equivalents of the claims.

The construction and method of operation of the invention, however, together with additional objects and advantages thereof will be best understood from the description of specific embodiments recited above.

We claim:

1. A method for cleaning a container to remove deposits, which comprises:

providing an alkaline cleaning solution, comprising from 40% to 50% by weight ammonium EDTA salt, from 0.1% to 2% by weight hydrazine, from 0.1% to 0.5% by weight of a surfactant, and a remainder of water;

introducing the alkaline cleaning solution into the container; and deqreasing and pickling the container in a one method step to remove the deposits.

2. The method according to claim 1, wherein the container is a boiler of a power station.

3. The method according to claim 1, which comprises setting a pH of the cleaning solution at least 8.5.

4. The method according to claim 1, which comprises setting a pH of the cleaning solution maximally at 10.

5. The method according to claim 1, which comprises carrying out the degreasing and pickling at a temperature below 100° C.

6. The method according to claim 1, which comprises removing magnetite and lime deposits with the pickling.

7. The method according to claim 1, wherein the ammonium EDTA salt is triammonium EDTA salt.

8. The method according to claim 1, wherein the surfactant is ethoxylated fatty alcohol.

* * * * *